US006183627B1

(12) United States Patent
Friday et al.

(10) Patent No.: US 6,183,627 B1
(45) Date of Patent: Feb. 6, 2001

(54) PROCESS AND APPARATUS FOR UPGRADING HYDROCARBON FEEDS CONTAINING SULFUR, METALS, AND ASPHALTENES

(75) Inventors: J. Robert Friday, Grantham, NH (US); Philip B. Rettger, Walnut Creek; Randall S. Goldstein, Moraga, both of CA (US)

(73) Assignee: Ormat Industries Ltd., Yavne (IL)

( * ) Notice: Under 35 U.S.C. 154(b), the term of this patent shall be extended for 0 days.

(21) Appl. No.: 09/261,157

(22) Filed: Mar. 3, 1999

Related U.S. Application Data

(63) Continuation-in-part of application No. 09/146,534, filed on Sep. 3, 1998.

(51) Int. Cl.[7] ..... C10G 65/12; C10G 69/04; C10G 51/06; C10G 3/00; C10G 45/00

(52) U.S. Cl. ..... 208/86; 208/61; 208/68; 208/80; 208/89

(58) Field of Search ..... 208/61, 68, 80, 208/86, 89

(56) References Cited

U.S. PATENT DOCUMENTS

| | | | |
|---|---|---|---|
| 3,637,483 | 1/1972 | Carey | 208/86 |
| 3,859,199 | 1/1975 | Gatsis | 208/97 |
| 4,039,429 | 8/1977 | van Klinken et al. | 208/50 |
| 4,062,758 | 12/1977 | Goudriaan et al. | 208/80 |
| 4,166,026 | 8/1979 | Fukui et al. | 209/210 |
| 4,200,519 | 4/1980 | Kwant et al. | 208/77 |
| 4,354,928 | 10/1982 | Audeh et al. | 208/309 |
| 4,400,264 | 8/1983 | Kwant et al. | 208/68 |
| 4,485,004 | 11/1984 | Fisher et al. . | |
| 4,498,974 | 2/1985 | Billon et al. | 208/96 |
| 4,537,676 | 8/1985 | Bearden et al. | 208/251 R |
| 4,640,762 | 2/1987 | Woods et al. . | |
| 5,192,421 | 3/1993 | Audeh et al. | 208/309 |
| 5,358,627 | 10/1994 | Mears et al. | 208/59 |
| 5,980,730 | 11/1999 | Morel et al. | 208/96 |

*Primary Examiner*—Walter D. Griffin
*Assistant Examiner*—Tam M. Nguyen
(74) *Attorney, Agent, or Firm*—Nath & Associates PLLC; Gary M. Nath; Jerald L. Meyer

(57) ABSTRACT

Upgrading of a hydrocarbon feed containing sulfur, metals, and asphaltenes involves applying the feed to a distillation column for producing a substantially asphaltene-free, and metal-free distillate fraction and a non-distilled fraction containing sulfur, asphaltenes, and metals. At least some of the substantially asphaltene-free, and metal-free distillate fraction is converted to a hydrogen donor diluent. The non-distilled fraction is processed in a solvent deasphalting unit for producing a deasphalted oil stream and an asphaltene stream. After a combined stream is formed from the hydrogen donor diluent and the deasphalted oil stream, the combined stream is thermally cracked forming a thermally cracked stream that is applied to the distillation column.

18 Claims, 2 Drawing Sheets

PROCESS AND APPARATUS FOR UPGRADING HYDROCARBON FEEDS CONTAINING SULFUR, METALS, AND ASPHALTENES

This application is a continuation-in-part application of U.S. patent application Ser. No. 09/146,534, filed Sep. 3, 1998, the contents of which are incorporated herein in their entirety.

DESCRIPTION

1. Technical Field

This invention relates to upgrading and desulfurizing heavy hydrocarbon feeds containing sulfur, metals, and asphaltenes, and more particularly, to a method of and apparatus for upgrading and desulfurizing heavy crude oils or fractions thereof.

2. Background of the Invention

Many types of heavy crude oils contain high concentrations of sulfur compounds, organo-metallic compounds, and heavy, non-distillable fractions called asphaltenes which are insoluble in light paraffins such as n-pentane. Because most petroleum products used for fuel must have a low sulfur content to comply with environmental restrictions, the presence of sulfur compounds in the non-distillable fractions reduces their value to petroleum refiners and increases their cost to users of such fractions as fuel or as raw material for producing other products. In order to increase the saleability of these non-distillable fractions, refiners must resort to various expedients for removing sulfur compounds.

A conventional approach to removing sulfur compounds in distillable fractions of crude oil, or its derivatives, is catalytic hydrogenation in the presence of molecular hydrogen at moderate pressure and temperature. While this approach is cost effective in removing sulfur from distillable oils, problems arise when the feed includes metallic-containing asphaltenes. Specifically, the presence of metallic-containing asphaltenes results in catalyst deactivation by reason of the coking tendency of the asphaltenes, and the accumulation of metals on the catalyst, especially nickel and vanadium compounds commonly found in the asphaltenes.

Alternative approaches include coking, high-pressure, desulfurization, and fluidized catalytic cracking of non-distillable oils, and production of asphalt for paving and other uses. All of these processes, however, have disadvantages that are intensified by the presence of high concentrations of metals, sulfur and asphaltenes. In the case of coking non-distillable oils, the cost is high and a disposal market for the resulting high sulfur coke must be found. Furthermore, the products produced from the asphaltene portion of the feed to a coker are almost entirely low valued coke and cracked gases. In the case of residual oil desulfurization, the cost of high-pressure equipment, catalyst consumption, and long processing times make this alternative undesirably expensive.

Metals contained in heavy oils contaminate and spoil the performance of catalysts in fluidized catalytic cracking units. Asphaltenes present in such oils are converted to high yields of coke and gas which burden an operator with high coke burning requirements. While asphalt markets represent a viable way to dispose of asphaltenes because, normally, no sulfur limits are imposed, such markets are limited in size and location, making this alternative frequently unavailable to a refiner.

Another alternative available to a refiner or heavy crude user is to dispose of the non-distillable heavy oil fractions as fuel for industrial power generation or as bunker fuel for ships. Disposal of such fractions as fuel is not particularly profitable to a refiner because more valuable distillate oils must be added in order to reduce viscosity sufficiently to allow handling and shipping, and because the presence of high sulfur and metals contaminants lessens the value to users. Refiners frequently use a thermal conversion process, e.g., visbreaking, for reducing the heavy fuel oil yield. This process converts a limited amount of the heavy oil to lower viscosity light oil, but has the disadvantage of using some of the higher valued distillate oils to reduce the viscosity of the heavy oil sufficiently to allow handling and shipping. Moreover, the asphaltene content of the heavy oil restricts severely the degree of visbreaking conversion possible due to the tendency of the asphaltenes to condense into heavier materials, even coke, and cause instability in the resulting fuel oil.

Many proposals thus have been made for dealing with non-distillable fractions of crude oil containing sulfur and metals. And while many are technically viable, they appear to have achieved little or no commercialization due, in large measure, to the high cost of the technology involved. Usually such cost takes the form of increased catalyst contamination by the metals and/or the carbon deposition resulting from the attempted conversion of the asphaltenes fractions.

An example of the processes proposed in order to cope with high metals and asphaltenes is disclosed in U.S. Pat. No. 4,500,416. In one embodiment, an asphaltene-containing hydrocarbon feed is solvent deasphalted in a deasphalting zone to produce a deasphalted oil (DAO) fraction, and an asphaltene fraction which is catalytically hydrotreated in a hydrotreating zone to produce a reduced asphaltene stream that is fractionated to produce light distillate fractions and a first heavy distillate fraction. Both the first heavy distillate fraction and the DAO fraction are thermally cracked into a product stream that is then fractionated into light fractions and a second heavy distillate fraction which is routed to the hydrotreating zone.

In an alternative embodiment, an asphaltene-containing hydrocarbon feed is solvent deasphalted in a deasphalting zone to produce a deasphalted oil (DAO) fraction, and an asphaltene fraction which is catalytically hydrotreated in a hydrotreating zone to produce a reduced asphaltene stream that is fractionated to produce light distillate fractions and a first heavy distillate fraction. The first heavy distillate fraction is routed to the deasphalting zone for deasphalting, and the DAO fraction is thermally cracked into a product stream that is then fractionated into light fractions and a second heavy distillate fraction which is routed to the hydrotreating zone.

In each embodiment in the '416 patent, asphaltenes are routed to a hydrotreating zone wherein heavy metals present in the asphaltenes cause a number of problems. Primarily, the presence of the heavy metals in the hydrotreater cause deactivation of the catalyst which increases the cost of operation. In addition, such heavy metals also result in having to employ higher pressures in the hydrotreater which complicates its design and operation and hence its cost.

It is therefore an object of the present invention to provide a new and improved method of and apparatus for upgrading and desulfurizing heavy hydrocarbon feeds containing sulfur, metals, and asphaltenes, wherein the disadvantages as outlined are reduced or substantially overcome.

SUMMARY OF THE INVENTION

In accordance with the present invention, a substantially asphaltene-free, and metal-free distillate stream is produced from a heavy hydrocarbon feed stream by solvent deasphalting the feed for producing a deasphalted oil fraction and an asphaltene fraction. The deasphalted oil fraction is thermal cracked in the presence of a hydrogen diluent for forming a thermally cracked stream which is fractionated in a fractionating zone to produce a substantially asphaltene-free, and metal-free distillate fraction that constitutes the distillate stream, and a non-distilled fraction that constitutes the feed stream.

Preferably, hydrogen donor diluent is produced by catalytically hydrogenating at least a portion of the substantially asphaltene-free, and metal-free distillate fraction for forming a hydrotreated stream. Such stream is then fractionated for forming a substantially asphaltenefree, and metal-free distillate, and the hydrogen donor diluent. The preferred ratio of hydrogen donor diluent to deasphalted oil is about 0.25 to 4 parts of hydrogen donor diluent to 1 part of deasphalted oil.

In one embodiment of the invention, fractionation of the thermally cracked stream includes fractionating a hydrocarbon feed containing sulfur, metals, and asphaltenes. In another embodiment, a hydrocarbon feed containing sulfur, metals, andl asphaltenes is thermally cracked with the deasphalted oil fraction and the hydrogen diluent.

The presence of hydrogen donor diluent during thermal cracking of the deasphalted oil serves to suppress or substantially eliminate the formation of asphaltenes in the thermal cracker. Moreover, in the preferred form of the invention, the feed to the catalytic hydrotreater is asphaltene-free and metal-free; and as a result only moderate pressures are involved in the hydrotreater thereby reducing the cost of the catalytic hydrotreating equipment. In addition, the improved feed to the catalytic hydrotreater will result in much longer catalyst life, thus reducing operating costs.

The solvent deasphalting process of the present invention removes both asphaltenes in the initial feed and asphaltenes formed as a by-product of the thermal cracking process. The absence of asphaltenes in the DAO input to the thermal cracker permits its operation under more severe conditions thereby maximizing the generation of distillate products. As is known, the severity of a thermal cracking process is limited by the level of asphaltenes present in the thermal cracker because too high a level will result in precipitation of asphaltenes in the thermal cracker which fouls the cracker heaters, or precipitation of asphaltenes from the thermal cracker liquid in subsequent storage or transport. Since the presence of asphaltenes sets the limit on conversion in a thermal cracker before excessive coking occurs, removal of asphaltenes from the feed to the thermal cracker allows for higher severity operations and higher conversion rates according to the present invention, and thus lower costs. Moreover, the donor diluent present in the input to the thermal cracker suppresses asphaltene production in the thermal cracker, providing an enhanced yield of light products.

An additional advantage of the present invention lies in using thermal, rather than catalytic, conversion of deasphalted oil. This allows the deasphalting process to be operated such that substantially only asphaltenes, and, therefore, very little deasphalted oil fractions are rejected to the asphaltene phase by the solvent deasphalter even though such operation results in deasphalted oil with a metals and Conradson Carbon level which would be unacceptable if the deasphalted oil were used in a catalytic cracker or catalytic hydrocracker. Since the conversion to distillable fractions occurs thermally, the metals and coke forming fractions do not create a significant cost penalty to the operation.

Substantially all of the metals in the feed are ultimately rejected into the asphaltene phase through the recycle of non-distilled, unconverted heavy oil to the solvent deasphalting unit. The inclusion of the hydrogen donor distillate with the deasphalted oil applied to the thermal cracker will suppress or substantially eliminate the coke forming fractions from condensing to form additional asphaltenes, thereby adding to the yield of valuable products.

According to the present invention, the asphaltenes present in the hydrocarbon to be upgraded are removed in the deasphalting step prior to the thermal cracking step. In addition, by recycling to the solvent deasphalting step the non-distilled residual fraction of the thermal cracker products, which fraction may contain asphaltenes created as a by-product of the thermal cracking, any thermal cracker-produced asphaltenes are removed and the deasphalted non-distilled residual fraction from the thermal cracker can be returned to the thermal cracker for further cracking. Thus, according to the present invention, the removal of asphaltenes from the initial and the recycled feedstocks upstream of the thermal cracker allows for a much-improved level of conversion of non-distilled hydrocarbon into distillates as compared to the prior art.

According to the present invention the asphaltenes produced from the invention can be used as fuel by another fuel user. For example, these asphaltenes can be used as fuel in a fluidized bed combustor or high viscosity fuel oil boiler. Alternatively, the asphaltenes can be used as feedstock to a gasifier, or they can be coked to produce lighter liquid fuels and petroleum coke fuel. If gasified, the syngas produced from the asphaltenes can be used as a source of hydrogen for the hydrotreater. If coked, the distillate fuel produced from the asphaltenes optionally may be hydrotreated and then combined with the distillate products that result from the cracking of the deasphalted oil, and the coke can be sold in the solid fuel markets.

The distilled fractions from the process, which are asphaltene-free and metal-free and have a reduced sulfur content, can be used without further treatment, as a replacement for premium distillate fuels or refinery feedstocks.

Furthermore, the present invention also comprises apparatus for carrying out the process of the present invention.

BRIEF DESCRIPTION OF THE DRAWINGS

Embodiments of the present invention are described by way of example, and with reference to the accompanying drawing wherein.

DETAILED DESCRIPTION

Figure 1:
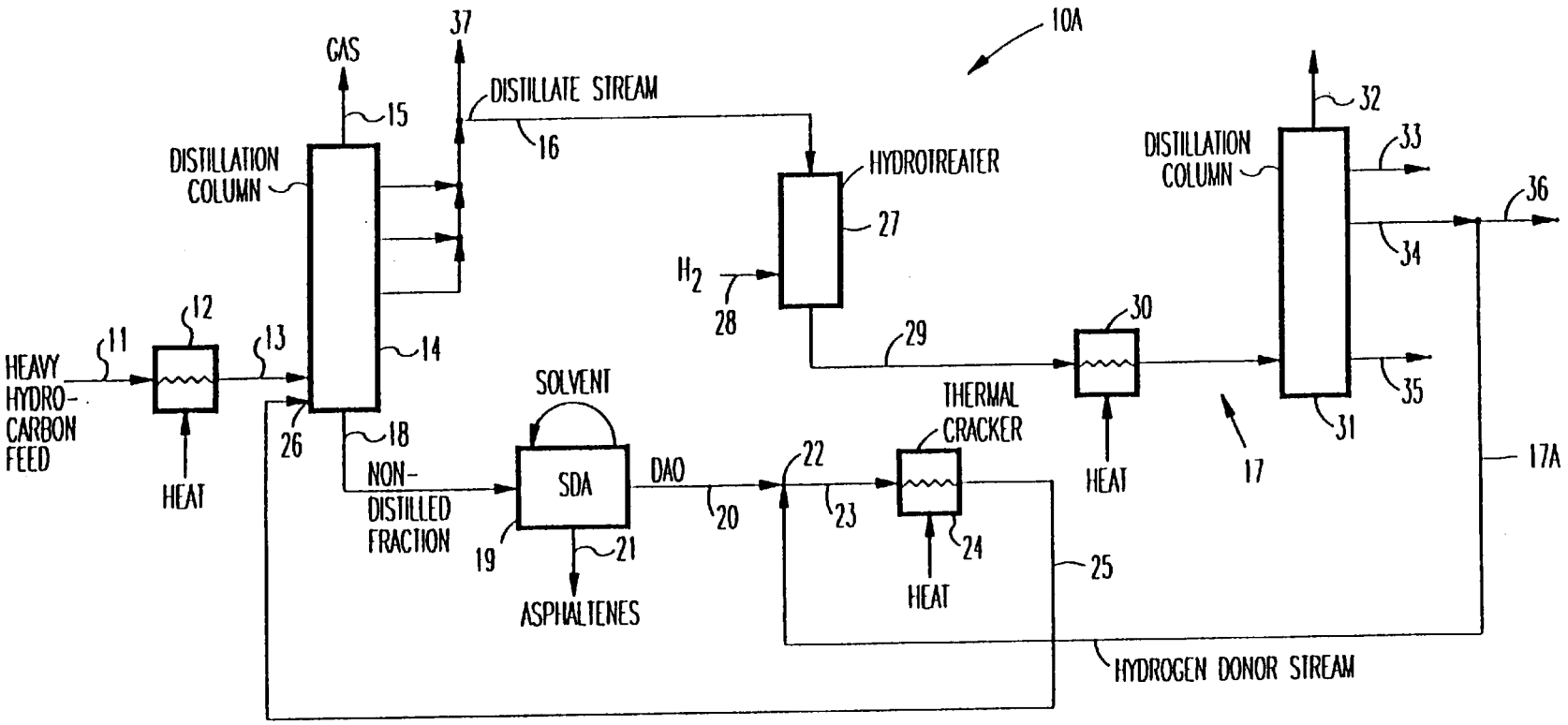
FIG. 1 is a block diagram of a first embodiment of the present invention for upgrading a hydrocarbon feed containing sulfur, metals, and asphaltenes wherein the feed is input to a distillation column.

Referring now to the drawings, reference numeral 10A designates a first embodiment of apparatus according to the present invention for upgrading hydrocarbon feed 11 which typically contains sulfur, metals, and asphaltenes. Apparatus 10A comprises heater 12 for heating feed 11 and producing heated feed 13 that is applied to distillation column 14 which can be operated at near-atmospheric pressure or, by the use of two separate vessels, at an ultimate pressure that is subatmospheric. Fractionation takes place within column 14 producing gas stream 15, one or more distillate streams shown as combined stream 16 which is a substantially asphaltene-free, and metal-free, and non-distilled fraction 18 containing sulfur, asphaltenes, and metals.

Gas stream 15 can be used as fuel for process heating. A portion of combined stream 16 may be withdrawn as output stream 37, and the balance of combined stream 16 is converted by means 17 to produce hydrogen donor diluent 17A as described below; and non-distilled, or reduced fraction 18 is applied to solvent deasphalting (SDA) unit 19 for processing the non-distilled fraction and producing deasphalted oil (DAO) stream 20 and asphaltene stream 21. SDA unit 19 is conventional in that it utilizes a recoverable light hydrocarbon such as pentane, or hexane, or a combination thereof, for separating fraction 18 into streams 20 and 21. The concentration of metals in DAO stream 20 produced by SDA unit 19 is substantially lower than the concentration of metals in fraction 18 applied to SDA unit 19. In addition, the concentration of metals in asphaltene stream 21 is substantially higher than concentration of metals in DAO stream 20. Node 22 serves as means to combine hydrogen donor diluent 17A with deasphalted oil stream 20 to form combined stream 23 which is thermally cracked in a cracking furnace or cracking furnace combined with a soaking drum, shown as thermal cracker 24. Preferably, deasphalted oil stream 20 is combined with the hydrogen donor stream 17A in the ratio of 0.25 to 4 parts of hydrogen donor to 1 part of deasphalted oil. The heat applied to thermal cracker 24 and the residence time of stream 23 therein serve to thermally crack stream 23 into light hydrocarbon distillable parts. Any asphaltenes formed during the thermal cracking of the non-distillable parts are a part of thermally cracked stream 25.

Figure 2:
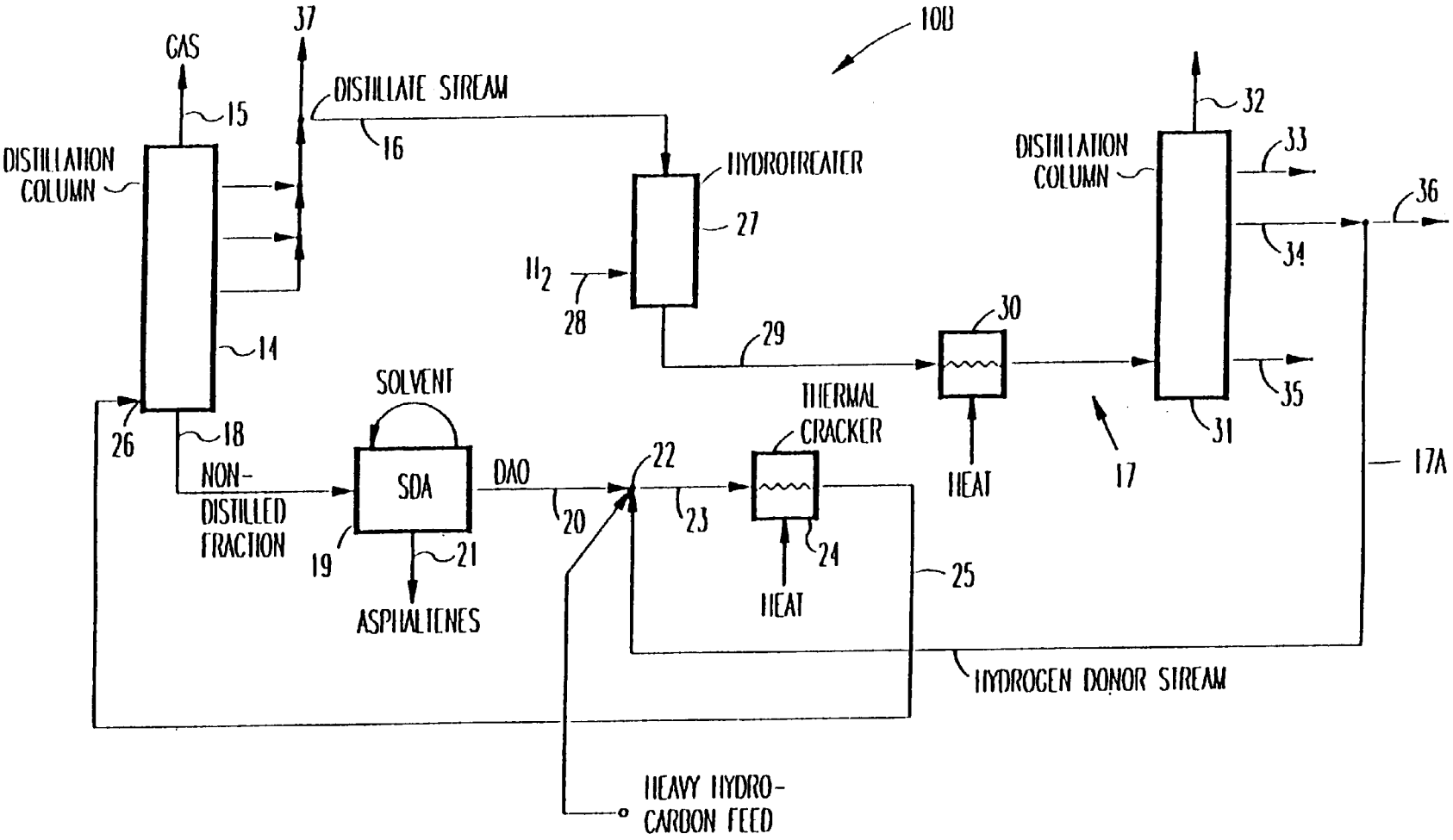
FIG. 2 is a block diagram of a second embodiment of the present invention for upgrading a hydrocarbon feed containing sulfur, metals, and asphaltenes wherein the feed is input to a thermal cracker.

Finally, input 26 to distillation column 14 serves as means for applying thermally cracked stream 25 to the column. Within this column, the distillable parts in stream 25 are separated and recovered as a part of gas stream 15 and combined stream 16. In the event that heavy hydrocarbon feed 11 does not contain a significant amount of distillate, feed 11 can be directed to the solvent deasphalting unit 19 instead of column 14 as shown in the drawing. Alternatively, when feed 11 contains sulfur, metals, and asphaltenes, feed 11 may be directed to thermal cracker 24 in apparatus lOB shown in FIG. 2.

While FIG. 1 shows feeding-back thermally cracked stream 25 directly to column 14, it is also possible to mix stream 25 with feed 11 thereby assisting the heating of the feed in preparation for fractionating in column 14.

Preferably, at least a portion of the distillate produced by column 14, namely stream 16, is catalytically hydrotreated in hydrotreater 27 which also receives gaseous hydrogen via line 28. The hydrotreated product in line 29 is then heated in heater 30 and fractionated in distillation column 31 producing gas stream 32, light distillates 33, middle-range distillates 34, and heavy distillates 35.

Gas stream 32 can be used, for example, as fuel for process heating; or, hydrogen in the gas stream can be recovered for use in hydrotreater 27. Stream 29 will also contain a significant amount of hydrogen sulfide from the desulfurization process in the hydrotreater. This hydrogen sulfide can be easily removed from the gas fraction using conventional technology for recovery of the sulfur.

A portion of the middle distillate fraction 34, which will have a boiling range of approximately 500° F. to 900° F., is used as the hydrogen donor diluent for the thermal cracking process and is recycled as stream 17A. The portion of the middle distillate fraction 34 that is not used as the hydrogen donor is withdrawn from the system as stream 36. Streams 32, 33, 35, 36, and 37 can be combined as an upgraded synthetic crude oil for further processing in a refinery, or used as fuel for power generation without further processing.

In one embodiment of the present invention the heater 12 functions as a thermal cracker in order to crack the heavy hydrocarbons in the hydrocarbon feed.

According to a preferred embodiment of the present invention, thermal cracker 24 contains a catalyst. In that embodiment wherein the heater 12 functions as a thermal cracker, it also can contain a catalyst. When a catalyst is present, thermal cracking is practiced in the presence of this catalyst. The catalyst can reside in the thermal cracker 24 and/or in the heater 12, but is preferably in the form of an oil dispersible slurry carried by the relevant feed stream.

The catalyst preferably promotes cracking of the combined stream 23 or the contents of the heater 12 when the heater 12 functions as a thermal cracker. In one embodiment the catalyst suppresses the formation of asphaltenes. In the most preferred embodiment it does both. The catalyst is preferably a metal selected from the group consisting of a Groups IVB, VB, VIB, VIIB, and VIII of the Periodic Table of Elements, and mixtures thereof. The most preferred catalyst is molybdenum. The catalyst can be employed in its elemental form or in the form of a compound.

In another embodiment the thermal cracking, which occurs in thermal cracker 24, is practiced in the presence of a hydrogen donor such as hydrogen gas or a hydrogen donor diluent stream.

In an additional embodiment of the present invention hydrogen gas is supplied to the thermal cracker 24 in order to improve performance. Furthermore hydrogen gas can be added to the heater 12 in that embodiment wherein the heater 12 functions as a thermal cracker.

It is believed that the advantages and improved results furnished by the method and apparatus of the present in are apparent from the foregoing description of the invention. Various changes and modifications may be made without departing from the spirit and scope of the invention as described in the claims that follow.

What is claimed is:

1. A process for upgrading a hydrocarbon feed containing sulfur, metals, and asphaltenes, said process comprising:

a) applying said feed to a distillation column for producing a substantially asphaltene-free, and metal-free distillate fraction and a non-distilled fraction containing sulfur, asphaltenes, and metals b) converting at least some of said substantially asphaltene-free, and metal-free distillate fraction to a hydrogen donor diluent;

c) processing said non-distilled fraction in a solvent deasphalting unit for producing a deasphalted oil stream and an asphaltene stream;

d) combining said hydrogen donor diluent with said deasphalted oil stream to form a combined stream;

e) thermal cracking said combined stream for forming a thermally cracked stream; and f) applying said thermally cracked stream to said distillation column.

2. A process according to claim 1 wherein said hydrogen donor diluent is combined with said deasphalted oil stream in the ratio of about 0.25 to 4 parts of hydrogen donor diluent to 1 part of deasphalted oil.

3. A process according to claim 2 wherein converting at least some of said substantially asphaltene-free, and metal-free distillate fraction to a hydrogen donor diluent includes:

a) catalytically hydrogenating at least a portion of said substantially asphaltene-free, and metal-free distillate fraction for forming a hydrotreated stream;

b) fractionating said hydrotreated stream for forming substantially asphaltene-free, and metal-free distillate, and said hydrogen donor diluent.

4. A process for producing a distillate stream from a heavy hydrocarbon feed stream comprising a) solvent deasphalting said feed for producing a deasphalted oil fraction and an asphaltene fraction;

b) forming a hydrogen donor diluent;

c) heating and thermal cracking said deasphalted oil fraction in the presence of said hydrogen donor diluent in a thermal cracking zone for forming a thermally cracked stream;

d) fractionating said thermally cracked stream in a fractionating zone to produce a distilled fraction which constitutes said distillate stream, and a non-distilled fraction which constitutes said feed stream; and e) wherein said hydrogen donor diluent is produced by hydrotreating a portion of said distillate stream.

5. A process according to claim 4 wherein said hydrogen donor diluent is combined with said deasphalted oil fraction in the ratio of about 0.25 to 4 parts of hydrogen donor diluent to 1 part of deasphalted oil.

6. A process according to claim 4 wherein the step of fractionating said thermally cracked stream includes fractionating a hydrocarbon feed containing sulfur, metals, and asphaltenes.

7. A process according to claim 4 including thermal cracking a hydrocarbon feed containing sulfur, metals, and asphaltenes in said thermal cracking zone.

8. A process according to claim 4 including burning at least a portion of said distillate stream for producing power.

9. A process for upgrading a hydrocarbon feed stream containing sulfur, metals, and asphaltenes, said process comprising:

a) cracking said hydrocarbon feed stream to form a cracked hydrocarbon feed stream;

b) applying said cracked hydrocarbon feed stream to a distillation column for producing a substantially asphaltene-free, and metal-free distillate fraction and a non-distilled fraction containing sulfur, asphaltenes, and metals;

c) converting at least some of said substantially asphaltene-free, and metal-free distillate fraction to a hydrogen donor diluent;

d) processing said non-distilled fraction in a solvent deasphalting unit for producing a deasphalted oil stream and an asphaltene stream;

e) combining said hydrogen donor diluent with said deasphalted oil stream to form a combined stream;

f) thermal cracking said combined stream for forming a thermally cracked stream; and g) applying said thermally cracked stream to said distillation column.

10. A process according to claim 4 wherein the thermal cracking of said combined stream is practiced in the presence of a catalyst.

11. A process according to claim 10 wherein the catalyst promotes cracking of said combined stream.

12. A process according to claim 10 wherein the catalyst suppresses the formation of asphaltenes.

13. A process according to claim 10 wherein the catalyst suppresses the formation of asphaltenes, and wherein the catalyst promotes cracking of said combined stream.

14. A process according to claim 10 wherein the catalyst is a metal selected from the group consisting of a Groups IVB, VB, VIB, VIIB, and VIII of the Periodic Table of Elements, and mixtures thereof.

15. A process according to claim 10 wherein the catalyst is a molybdenum.

16. A process of claim 1 wherein the thermal cracking is practiced in the presence of a hydrogen donor.

17. A process of claim 16 wherein the hydrogen donor is hydrogen gas.

18. A process of claim 16 wherein the hydrogen donor is a hydrogen donor diluent stream.

* * * * *